US006604606B1

(12) United States Patent
McDougal et al.

(10) Patent No.: US 6,604,606 B1
(45) Date of Patent: Aug. 12, 2003

(54) PORTABLE UTILITY STAND

(76) Inventors: Art McDougal, 110 Dutch Island Dr., Savannah, GA (US) 31406; Ed Ellis, 152 N. Harbor Dr., Harbor Island, SC (US) 29920

( * ) Notice: Subject to any disclaimer, the term of this patent is extended or adjusted under 35 U.S.C. 154(b) by 0 days.

(21) Appl. No.: 10/078,389

(22) Filed: Feb. 21, 2002

(51) Int. Cl.[7] ..... E06C 5/00
(52) U.S. Cl. ..... 182/127; 182/115; 182/63.1
(58) Field of Search ..... 182/63.1, 127, 182/116, 115

(56) References Cited

U.S. PATENT DOCUMENTS

| | | | | |
|---|---|---|---|---|
| 3,157,248 A | * | 11/1964 | Nesslinger | 182/152 |
| 3,282,375 A | | 11/1966 | Ray | |
| 3,327,810 A | * | 6/1967 | Johnson | 182/17 |
| 3,406,784 A | | 10/1968 | Jones et al. | |
| 4,614,252 A | | 9/1986 | Tarner | |
| 4,625,831 A | | 12/1986 | Rodgers, Jr. | |
| 4,696,374 A | | 9/1987 | Hale | |
| 4,787,477 A | | 11/1988 | Dolan | |
| 4,800,986 A | | 1/1989 | Hayes, III | |
| 5,042,614 A | | 8/1991 | Rainey | |
| 5,297,844 A | | 3/1994 | Haustein | |
| 5,409,081 A | | 4/1995 | Reeves | |
| 5,881,839 A | | 3/1999 | Stanley | |
| 6,053,282 A | * | 4/2000 | Marisak | 182/113 |
| 6,105,721 A | | 8/2000 | Haynes | |
| 6,523,641 B2 | * | 2/2003 | Smith | 182/63.1 |

FOREIGN PATENT DOCUMENTS

| | | |
|---|---|---|
| CA | 1231686 | 1/1988 |
| DE | 3503771 | 8/1986 |
| DE | 4222353 | 11/1993 |

* cited by examiner

*Primary Examiner*—Alvin Chin-Shue
(74) *Attorney, Agent, or Firm*—Richard C. Litman

(57) ABSTRACT

A portable utility stand for use by hunters, wildlife photographers, security personnel, etc. attaches removably to a small, light weight off road vehicle (golf cart, all terrain vehicle, etc.). The stand essentially comprises a lower portion which is immovably affixed to the vehicle, and an upper portion which is pivotally attached to the upper rear of the lower portion and which folds forwardly for storage atop the lower portion of the stand on the vehicle. The upper portion of the stand includes an observation seat which is pivotally mounted to an upper platform to provide an observer with a 360 degree field of view. The seat is positioned essentially over the center of gravity of the vehicle when the stand is erected, and a pair of lateral braces is provided for additional stability and safety. A folding safety guard is also provided to surround a person seated atop the stand.

17 Claims, 10 Drawing Sheets

PORTABLE UTILITY STAND

BACKGROUND OF THE INVENTION

1. Field of the Invention

The present invention relates generally to movable stands, towers, and the like for supporting a hunter, photographer, etc. in the field. More specifically, the present invention relates to a stand which may be carried upon a small off road vehicle (golf cart, all terrain vehicle, etc.) or alternatively in the bed of a pickup truck or the like, for transport and erection at any practicable location desired.

2. Description of the Related Art

The advantages provided by a relatively high viewing platform, have been well known for generations. Hunters have particularly found that a high vantage point provides many advantages, e.g., a larger and wider field of view than that obtained at ground level, and perhaps more importantly, the elevation of the hunter above the normal horizontal line of sight of most game animals. It is a well established fact that most land animals (including humans) are adapted to devote most of their visual attention within a relatively few degrees of visual field above and below the horizon. However, the advantages of an elevated viewing position are evident in many other fields as well, e.g., photography at races and other events, security guard operations and crowd monitoring, safety applications (lifeguards), etc.

Many such stands of the prior art are permanently installed facilities, particularly where used for security and safety purposes. However, the need for portability has long been recognized, particularly for use in hunting, photography, and observation of temporary events. The tree stand concept is well known in hunting and wildlife photography, but requires a tree, pole, or other tall, narrow object which can be scaled and to which the stand may be temporarily affixed. Such stands may be portable, but the object to which they attach is not, and such stands are not self-supporting. While other portable stands have been developed for carriage upon a motor vehicle of some sort, they have generally been relatively heavy and bulky, requiring a relatively large vehicle (e.g., pickup truck, etc.) for support.

Where smaller and lighter stands have been developed for carriage by lighter vehicles, they generally limit the utility of the vehicle to only carriage of the stand, and perhaps a single operator; it is generally not possible to carry any significant load (e.g., a large game animal, etc.) on an all terrain vehicle which has been fitted with a stand according to the prior art. Where the stand has been constructed so as to provide additional carrying space or area on the vehicle, the stand is generally not particularly high when erected, and does not provide significant additional elevation to the hunter or other user. Moreover, where such prior art stands do not utilize an existing fixed structure (tree, etc.) for stability, they generally rely upon the vehicle alone for stability, and do not provide the stability desired.

Accordingly, a need will be seen for a portable utility stand which may be installed upon a small, light weight off road vehicle (golf cart, all terrain vehicle, etc.) as well as within the bed of a pickup truck or the like. The present stand provides sufficient room when folded, to allow the vehicle to be used for the carriage of other articles as well. Yet, the present stand provides a significant height advantage when erected, raising the eye of a person seated therein to a point approximately sixteen feet above the surface.

The present stand also provides the necessary stability for such relatively high erected configurations, and includes laterally braces as well as fore and aft attachment to the underlying vehicle. The person seated in the seat of the present stand when erected, is positioned essentially directly over the center of gravity of the vehicle when the vehicle is parked on level ground, thus providing a safe and secure stand for the user. The present stand is relatively light in weight and may be erected and stowed manually in only a few minutes by a single individual Alternatively, powered means (hydraulic, electric, etc.) may be provided for the erection of the present stand, if so desired, thus enabling a person having limited physical strength or dexterity to take advantage of the benefits provided by the present stand.

A discussion of the related art of which the present inventor is aware, and its differences and distinctions from the present invention, is provided below.

U.S. Pat. No. 3,282,375 issued on Nov. 1, 1966 to Kenneth V. Ray, titled "Mobile Stand For Hunters Convertible To A Hand Cart," describes a wheeled device having a folding ladder extending therefrom. The ladder may be extended, the wheels braced upon the underlying surface, and the upper end of the ladder secured to a permanent structure (tree, etc.), with a platform at the upper end of the ladder serving as a hunting stand or the like. The Ray stand requires that another fixed object, such as a tree, be used to support and brace his stand, whereas the present stand, in combination with the vehicle upon which it is carried, is free standing and needs no other support. The present stand provides additional advantages as well, such as a swiveling seat providing 360 degrees of freedom for the observer, which is not possible for a device which is braced against an existing fixed structure.

U.S. Pat. No. 3,406,784 issued on Oct. 22, 1968 to Glendale Jones et al., titled "Portable Hunting Stand," describes two embodiments in which a folding stand is secured to the back of a vehicle. The vehicles to which the Jones et al. stand attaches are relatively large, comprising a pickup truck type vehicle and a Jeep style vehicle with no top. In the case of the Jeep type vehicle, the stand telescopes vertically upon four columns, rather than folding about a pair of pivots, as in the case of the present stand. Neither embodiment provides any lateral bracing means or swiveling seating, both of which are features of the present portable utility stand invention.

U.S. Pat. No. 4,614,252 issued on Sep. 30, 1986 to David E. Tarner, titled "Portable Observation Structure," describes two embodiments of a portable stand mounted on the back or to the luggage rack of a vehicle. In both embodiments, a lower tower is provided, with a ladder-like structure pivotally extending from the top of the tower. While a pair of rearward braces is provided, no lateral braces are provided for lateral stability. In the embodiment mounted upon a small all terrain vehicle, the folding upper portion of the device must be braced against an existing object (tree, etc.), unlike the present self-supporting stand. The second embodiment comprises a tower structure having four corner arms, with the fore and aft arms on each side meeting at the top. This structure is similar to the non-folding lower structure of the first embodiment, and cannot fold; it remains upright at all times.

U.S. Pat. No. 4,625,831 issued on Dec. 2, 1986 to Harvey B. Rodgers, Jr., titled "Deer Stand," describes a folding ladder arrangement with a tree braced seat at its upper end. The Rodgers, Jr. stand with its triple sections and double pivots can fold quite compactly, but its small size does not provide a particularly high platform when erected. Moreover, it must rely upon a fixed object (tree, etc.) to support the upper end when erected, unlike the present portable stand invention. The Rodgers, Jr. stand essentially fills the storage area of the vehicle when it is folded for transport and Rodgers, Jr. does not provide any form of lateral bracing, unlike the present invention.

U.S. Pat. No. 4,696,374 issued on Sep. 29, 1987 to John E. Hale, titled "ATV Hunting Stand," describes a stand structure mounted upon the rear portion of an all terrain vehicle or the like. The basic structure remains erected at all times, with a seat attached to the top of the structure folding downwardly to reduce the overall height of the structure. However, only the seat folds to reduce the height of the Hale stand; the remainder of the structure remains upright. Hale also provides bracing for his stand, but the bracing is limited to supporting the rear of the stand as it extends outwardly beyond the rear of the vehicle (col. 5, lines 52–56). Moreover, Hale does not provide any pivoting action for the top mounted seat, due to its folding action.

U.S. Pat. No. 4,787,477 issued on Nov. 29, 1988 to Rex H. Dolan, titled "Stand For All-Terrain Vehicle," describes an assembly somewhat resembling the stand or tower of the Tarner U.S. Pat. No. '252, discussed further above. The Dolan stand is self-supporting from the back of an all terrain vehicle, and folds with the fore and aft lower leg portions on each side, nesting against one another. A rigid, relatively immovable seat platform is affixed to the upper ends of the upper leg portions. No lateral bracing is disclosed, nor is any means of rotating or pivoting the seat disclosed by Dolan, in contrast to the present portable utility stand. Also, as in the case of the other stands discussed to this point, no lower attachment fittings are disclosed in order to provide a more solid and rigid attachment for the stand, as provided by the present portable utility stand invention.

U.S. Pat. No. 4,800,986 issued on Jan. 31, 1989 to James C. Hayes III, titled "Collapsible Tower For ATVs," describes a stand having four legs, with the lower ends of the rear legs being removable and securable adjacent the lower ends of the forward legs for lowering the stand to a storage and transport position. This arrangement positions the seat over the forward end of the vehicle, rather than centering the seat over the vehicle, as is the case with the present stand. The Hayes, III stand includes a pair of diagonal braces across the upper ends of the rearward legs, with the braces essentially centered over the ATV cargo area in back of the operator when the stand is lowered. This greatly reduces the utility of the ATV, as its cargo area cannot be used for carriage of any bulky cargo (game animal, etc.) when the stand is lowered.

U.S. Pat. No. 5,042,614 issued on Aug. 27, 1991 to Robert P. Rainey, titled "Adaptable Hunting Stand For Ladder-Like Use Or A-Frame Use," describes a stand which may be erected against a fixed object, or as a free standing unit atop an ATV. The Rainey stand more closely resembles the stand of the Dolan U.S. Pat. No. '477, than it does the present invention. The Rainey stand uses four legs, each comprising an upper and a lower section. The lower ends of the legs clamp to the conventional forward and rearward cargo racks of the ATV, when the stand is erected. However, Rainey does not disclose the configuration of the folded stand. It would appear that the collection of tubes and elements would have to be strapped or otherwise secured across the vehicle, rather than stored as a folded frame over the vehicle, as in the present stand.

U.S. Pat. No. 5,297,844 issued on Mar. 29, 1994 to Herbert H. Haustein, titled "Removable Cab And Stand For All Terrain Vehicles," describes a framework which secures removably to the existing conventional forward and rearward cargo racks of an ATV, somewhat like the stand of the Rainey U.S. Pat. No. '614 discussed immediately above. However, the basic framework of the Haustein structure does not fold, but rather remains in place to support a folding seat support structure thereatop, unlike the present invention. The Haustein seat does not swivel or pivot, as does the present seat, and the structure does not secure to the lower portion of the vehicle for greater structural integrity, as does the present stand structure.

U.S. Pat. No. 5,409,081 issued on Apr. 25, 1995 to Johnny F. Reeves, titled "Mobile Hunting Apparatus," describes an assembly having a fixed holding stand extending above the vehicle, for carrying the pivotally mounted stand thereon for transport. The hunting stand itself does not fold, but is pivotally attached to the back of the vehicle. As such, the height of the assembly when the stand is pivoted forward for carriage on the vehicle, is very little less than the height of the stand when deployed in its upright position behind the vehicle. The Reeves stand is only supported by the vehicle when it is being transported, and rests upon the ground behind the vehicle while in use. In fact, it could be disconnected from the vehicle when erected, without affecting its stability. Reeves therefore does not provide any form of lateral bracing extending from the vehicle.

U.S. Pat. No. 5,881,839 issued on Mar. 16, 1999 to Cecil A. Stanley, titled "Mobile Hunter's Stand," describes a stand having a fixed structure which bolts into the bed of a pickup truck, with a pivotally mounted folding structure secured thereto. Stanley emphasizes the use of a pickup truck for the carriage of his stand, which provides a much heavier base than a lighter all terrain vehicle or other off road vehicle (golf cart, etc.). Accordingly, Stanley does not provide any form of lateral bracing to support his stand when erected, as provided by the present invention. Moreover, as the Stanley stand is carried in the bed of a pickup truck, it folds rearwardly over the bed for storage, rather than folding forwardly over the seating area of the vehicle, as in the case of the present stand.

U.S. Pat. No. 6,105,721 issued on Aug. 22, 2000 to Rusty, Haynes, titled "Accessory For Use With An ATV," describes a rectangular frame which affixes immovably to a small all terrain vehicle or the like. While Haynes provides a seat atop the structure, he does not disclose any swiveling or other articulation for the seat, whereas the seat of the present utility stand is pivotally mounted for greater versatility. Moreover, the Haynes stand does not fold in any way, and does not provide a significant increase in height for the hunter or observer, as does the present stand. Also, no Haynes does not provide any form of lateral bracing to support his stand, due to the relatively low height off the Haynes assembly.

German Patent Publication No. 3,503,771 published on Aug. 7, 1986 to Friedrich Peters describes (according to the drawings and English abstract) a permanently installed stand supported by and extending above the underlying surface. No vehicle support nor lateral bracing is apparent for the stand of the '771 German Patent Publication. Rather than pivoting only the seat, the entire upper enclosure of the '771 German Patent Publication stand revolves. It is not clear from the drawings, just how this mechanism operates atop the four apparently fixed support legs of the stand.

Canadian Patent Publication No. 1,231,686 issued on Jan. 19, 1988 to Ricky A. Purdy, titled "Deer Stand," describes a stand essentially comprising a telescoping ladder which secures to a tree or other fixed structure at its upper end. No vehicle support or carriage is disclosed for the stand of the '686 Canadian Patent. The stand of the '686 Canadian Patent more closely resembles the stand of the '375 U.S. Patent to Ray, discussed further above (excepting the wheels on the stand of the '375 U.S. Patent), than it does the present utility stand invention.

Finally, German Patent Publication No. 4,222,353 published on Nov. 25, 1993 to Horst Probst describes (according to the drawings and English abstract) a stand supported by a single leg which is driven into the ground, with a series of ropes or the like in tension extending outwardly and downwardly therefrom to stabilize the assembly. No vehicle support or folding (other than the flexible ropes or chains) is indicated in the '353 German Patent Publication.

None of the above inventions and patents, taken either singularly or in combination, is seen to describe the instant invention as claimed. Thus a portable utility stand solving the aforementioned problems is desired.

SUMMARY OF THE INVENTION

The present invention is a utility stand for use by hunters, wildlife observers and photographers, security personnel, and others who have need of a portable elevated viewing platform. The present stand is removably installed upon a small off road vehicle (golf cart, all terrain vehicle, etc.), but may also be installed upon a larger vehicle, e.g., within the bed of a pickup truck, etc.

The present stand essentially comprises two major portions. The lower portion is immovably affixed to the vehicle structure, and provides support for the folding upper structure attached thereto. The upper structure is pivotally attached to the lower structure at the upper rear corners of the lower structure, and folds downwardly and forwardly atop the lower structure and over the top of the vehicle for storage and transport. When the upper structure is erected for use, the seat located thereatop is positioned essentially over the center of gravity of the vehicle for safety and stability. A pair of folding lateral braces may be extended to the sides of the vehicle, for greater stability and security.

A pivotally mounted seat is provided atop the folding portion of the structure, allowing the person seated therein to have a 360 degree horizontal field of view by rotating the seat as desired. A hinged safety guard and rest is also provided, which is lowered to surround the seated person to the sides and front thereof. The safety guard provides additional security for the seated person, and also serves as a rest or brace for a rifle or other firearm, a camera, binoculars, and/or other equipment as desired.

The present stand is easily erected by positioning the support vehicle as desired, raising the front of the upper assembly, and locking it in place with a series of pins provided. The lateral braces are then extended and adjusted as required. A ladder is deployed from its storage position at the back of the lower structure, for use in climbing aboard the vehicle. The back of the lower structure and upper structure also include a series of lateral bars for use as a ladder.

When use of the stand is no longer needed at that location, the steps involved in the erection of the stand are reversed to fold the stand atop the vehicle. The vehicle with the folded stand stored thereatop, may be driven to any other practicable location as desired for redeployment of the stand, or the vehicle with the attached stand assembly may be placed in storage as desired. Smaller off road vehicles, e.g., golf carts and all terrain vehicles, are commonly carried within the beds of pickup trucks and the like for use in hunting trips, and the off road vehicle with its attached stand may also be transported using a larger vehicle.

Accordingly, it is a principal object of the invention to provide a portable utility stand for removable attachment to a small off road vehicle, for use in hunting, wildlife observation and photography, security operations, and other environments where a temporary, portable, elevated platform is required.

It is another object of the invention to provide such a stand comprising a lower portion which is immovably affixed to a golf cart, all terrain vehicle, or similar transportation, with an upper portion pivotally attached to the upper rear of the lower portion and folding upwardly therefrom for erection of the assembly.

It is a further object of the invention to provide such a stand in which the single seat is positioned substantially over the center of gravity of the vehicle when the stand is erected, and which includes lateral support braces for additional stability and safety.

Still another object of the invention is to provide such a stand in which the seat is pivotally mounted to provide the user with a 360 degree horizontal field of view, and which includes a safety guard and rest which may be lowered about the sides and front of the person seated upon the present stand.

It is an object of the invention to provide improved elements and arrangements thereof for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a portable utility stand which may be installed upon and used with one of various types of off road vehicles. The present utility stand is particularly useful to hunters who require a relatively elevated platform for game observation and shooting, but the stand is also useful to wildlife photographers, photographers at sporting events and related activities, etc. The present stand and vehicle also work well to provide an observation point for security personnel, e.g. airport, parking lots and check-in areas, prison guards and border patrol, lifeguards at beaches, etc. The present stand is easily moved about to any location where it is most urgently needed, and can replace or supplement existing stationary observation towers.

Figure 1:
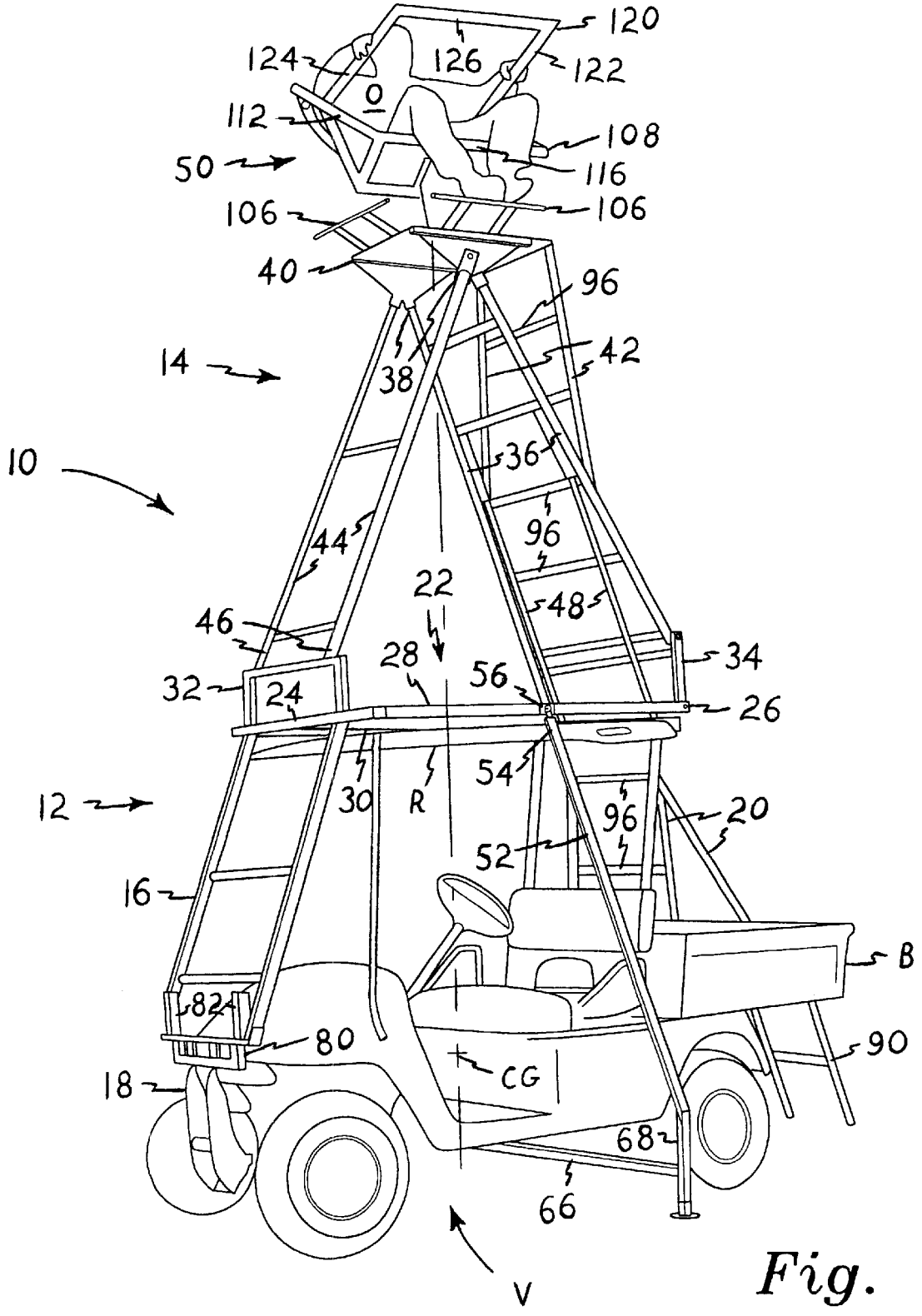
FIG. 1 is a perspective view of the portable utility stand according to the present invention, as it would be erected for use in the field.

FIG. 1 provides an illustration of the present portable utility stand 10 in its raised or erected configuration atop a small off road vehicle V. The off road vehicle V illustrated in the drawing Figures comprises a golf cart type vehicle having a roof R and cargo box B, as well as other features conventional for such vehicles, However, the present stand 10 is also adaptable to other similar vehicles, such as conventional four wheel all terrain vehicles (ATVs), smaller garden type utility trucks having configurations similar to the golf cart vehicle V illustrated in the drawing Figures, etc., and can even be installed within the bed of a conventional pickup truck or the like. The specific type of vehicle is not particularly critical, so long as it provides the required structure for installing the present stand 10 thereto.

The utility stand 10 essentially comprises two major components or portions, having a lower frame portion 12 which is immovably affixed to the supporting vehicle V and an upper frame portion 14 which folds forwardly and downwardly over the roof R of the vehicle V and the top of the lower, fixed frame portion 12 for storage and transport. The lower and upper frame portions or structures 12 and 14 are preferably constructed of square and/or round cross section metal tubing, for an optimum balance between the required strength of the structure and a relatively light weight and economy of construction. Aluminum has been found to work well for such structures, although steel tubing or even other materials may be used as desired.

Figure 7:
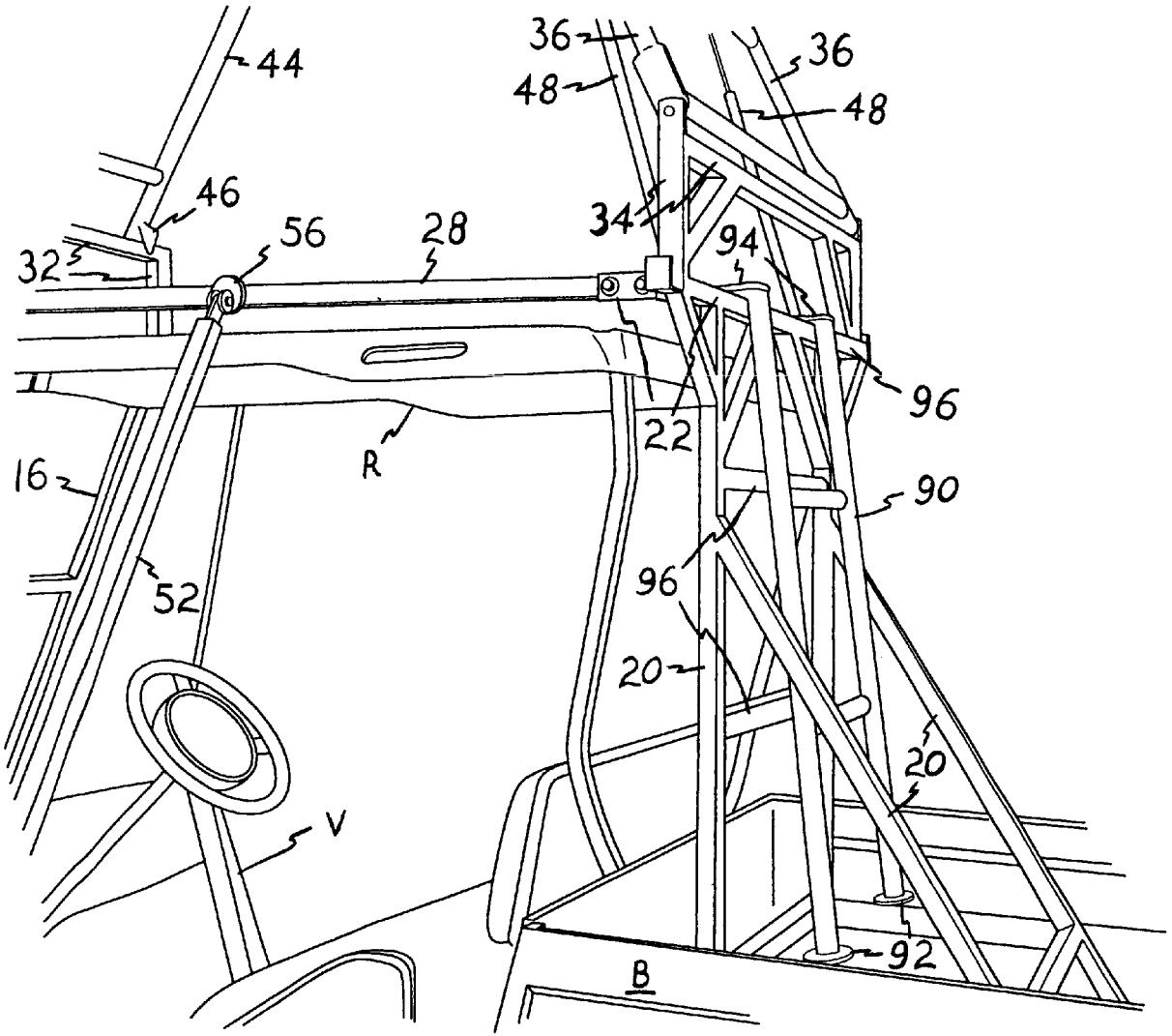
FIG. 7 is a partial left side perspective view, showing details of the left side and rear structure of the stand assembly including the stored access ladder.

The lower frame portion 12 of the stand 10 includes a forward support structure 16 essentially comprising a pair of generally vertical members extending upwardly from a forward vehicle attachment fitting 18, which in turn attaches to the conventional forward structure of the vehicle V. A rear support structure 20 includes a pair of generally vertical elements which are secured (bolted, etc.) into the cargo box B or other structure of the vehicle V, generally as shown in FIG. 7. The forward and rearward support structures 16 and 20 of the lower frame assembly 12 in turn attach to an upper structure 22 at the forward portion 24 and rearward portion 26 thereof. The upper structure 22 of the lower frame portion 12 generally comprises a rectangular frame having a left and a right side member, respectively 28 and 30, extending generally horizontally over the roof R of the vehicle V.

The forward and rearward ends 24 and 26 of the upper rack structure 22 of the fixed lower portion 12, each include a raised support, respectively 32 and 34, for attaching and supporting the folding upper portion 14 of the stand 10. The upper portion 14 includes a first pair of legs 36, which form the rear legs for the upper portion 14 of the stand 10 when the upper portion 14 is erected. These legs 36 are pivotally attached to the rear support 34 of the upper structure 22 of the fixed lower portion 12 of the stand 10.

The distal or upper (when the upper portion of the stand 10 is erected) ends 38 of the legs 36 include a seat support platform 46 rigidly affixed thereto. A set of auxiliary brace legs 42 extend from the first or rear upper portion legs 36 to the rear edge of the seating platform 40, and serve as additional bracing for the platform 40 and also as the uprights for a ladder structure for the hunter or other person climbing the structure.

A pair of second or forward upper portion legs 44 are pivotally attached to the structure of the seating platform 40, and extend forwardly and downwardly from the seat platform 40 when the, upper portion 14 of the stand 10 is erected for use. The lower ends 46 of the second leg pair 44 secure removably to the forward upper structure support 32 when the structure is erected, as shown in detail in FIG. 6 of the drawings and discussed further below. These forward legs 44 telescopingly retract in the conventional manner (not shown) when the upper stand portion 12 is folded, for compact storage of the folded assembly.

Figure 2:
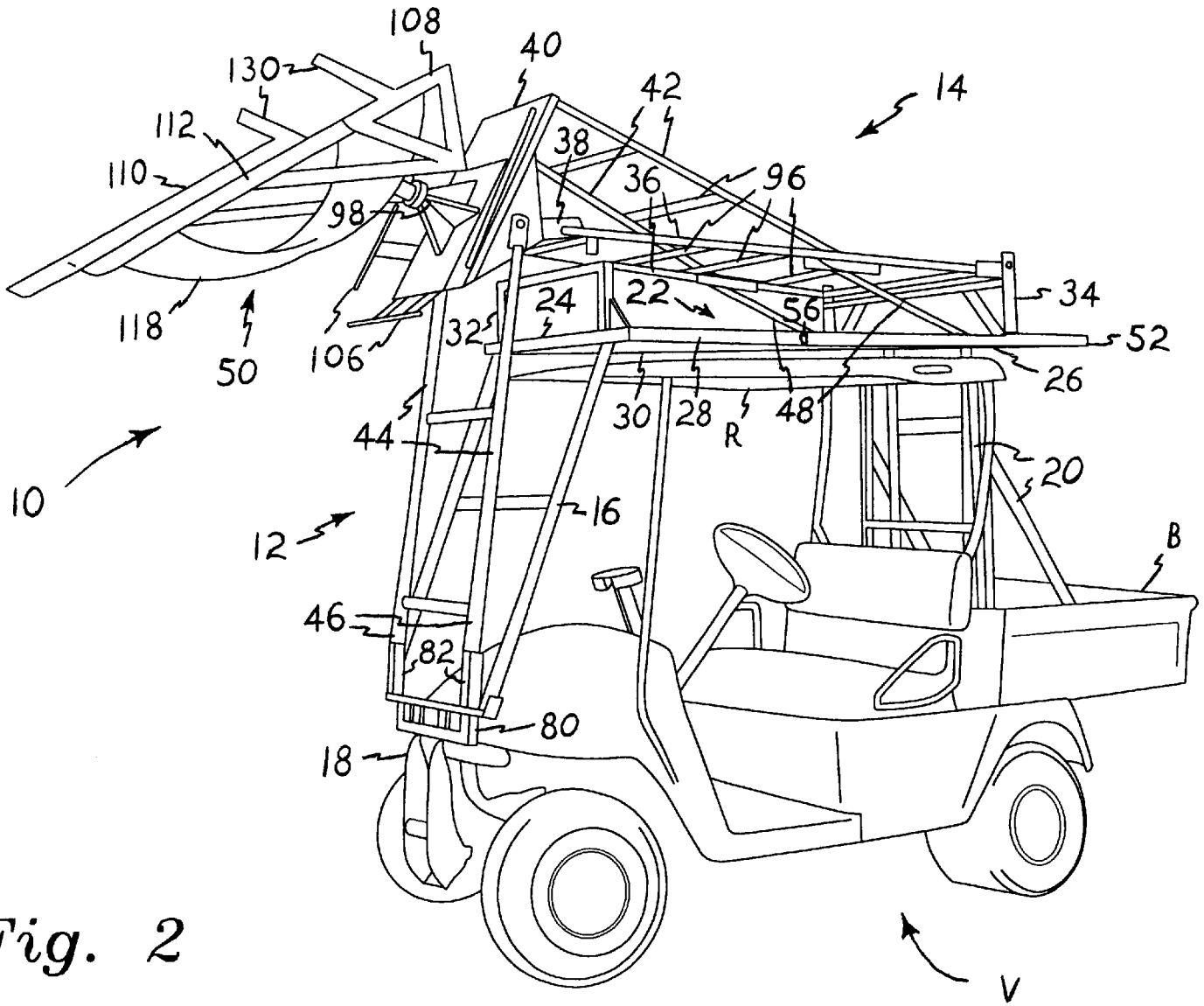
FIG. 2 is a perspective view of the present stand, folded for storage and transport atop the vehicle with which it is installed.

By comparing the erected configuration of the present utility stand 10 shown in FIG. 1 with the folded condition shown in FIG. 2, it will be seen that the upper portion 14 of the stand 10 pivots arcuately upwardly and rearwardly from the lower portion 12 to raise the upper portion 14, by means of the pivotal attachment of the lower ends of the first or rearward upper structure legs 36 to the rearward upper strut support structure 34. The second or forward upper portion legs 44 are telescopingly extended and locked in their extended state by means of conventional lateral pins (not shown) which are inserted diametrically through the legs 44. The lower ends 46 of these two legs 44 are secured to the crossmember of the forward upper structure support 32 to support the erected upper portion 14 of the stand 10, as shown in detail in FIG. 6 of the drawings and discussed in detail further below.

A pair of lift assist struts 48 (e.g., pneumatically inflated telescoping struts as used in holding the rear hatch of an automobile open, or alternatively mechanical spring loaded struts, etc., as desired) may be provided between the fixed upper structure 22 of the lower portion 12 of the assembly and the pivotally attached rearward legs 36 of the upper portion 14 of the assembly, if so desired. Such compressively loaded struts 48 provide additional lifting force for reducing the manual force required to lift the legs 36 and 44 and attached seat platform 40, and other movable components. Alternatively, the struts 48 may comprise hydraulically or electrically powered units, receiving power from a power source provided by the vehicle V.

The erected structure 10 as shown in FIG. 1, will be seen to be relatively tall in comparison to the width of the vehicle V. The present stand 10 is capable of raising the line of sight of a person seated in the seat 50 thereof, to a height of just about sixteen feet above the underlying surface upon which the vehicle V is resting. Careful consideration of the lengths of the extended forward legs 44 and rearward legs 36, results in the placement of the seating platform 40 (and seat 50 installed thereon with observer O seated in the seat 50) very nearly directly over the center of gravity CG of the vehicle V when the vehicle V is parked on substantially level terrain, generally as shown in FIG. 1 of the drawings.

However, even though the seat 50 is positioned essentially over the center of gravity CG of the vehicle V, the relatively narrow width of the off road vehicle V may not provide the lateral stability desired for the erected stand 10. Accordingly, the present invention includes lateral stabilizing means, comprising a left and a right lateral stabilizing brace 52.

Figure 3:
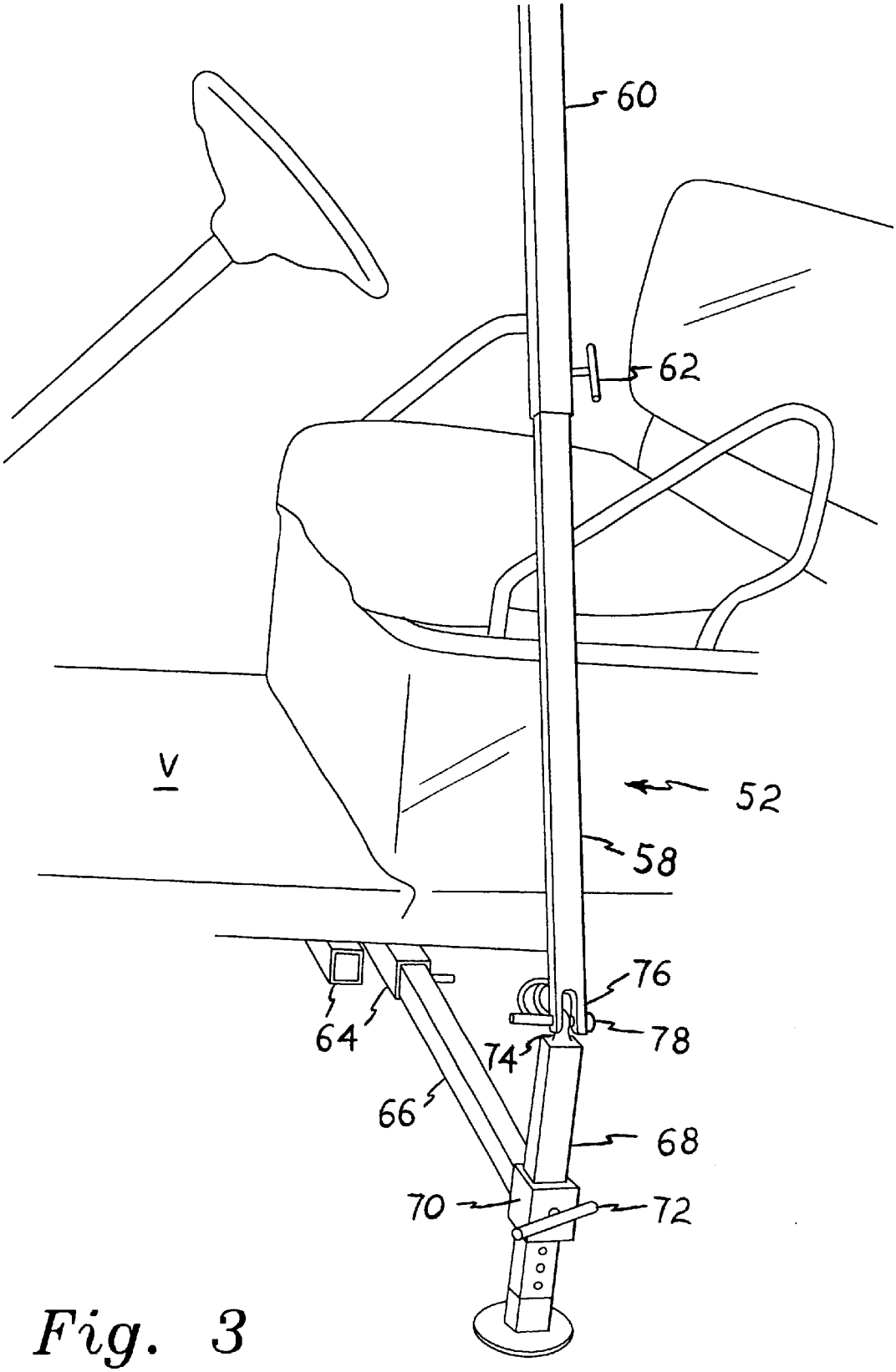
FIG. 3 is a partial left side perspective view, showing details of the lower portion of the left lateral brace assembly.
Figure 4:
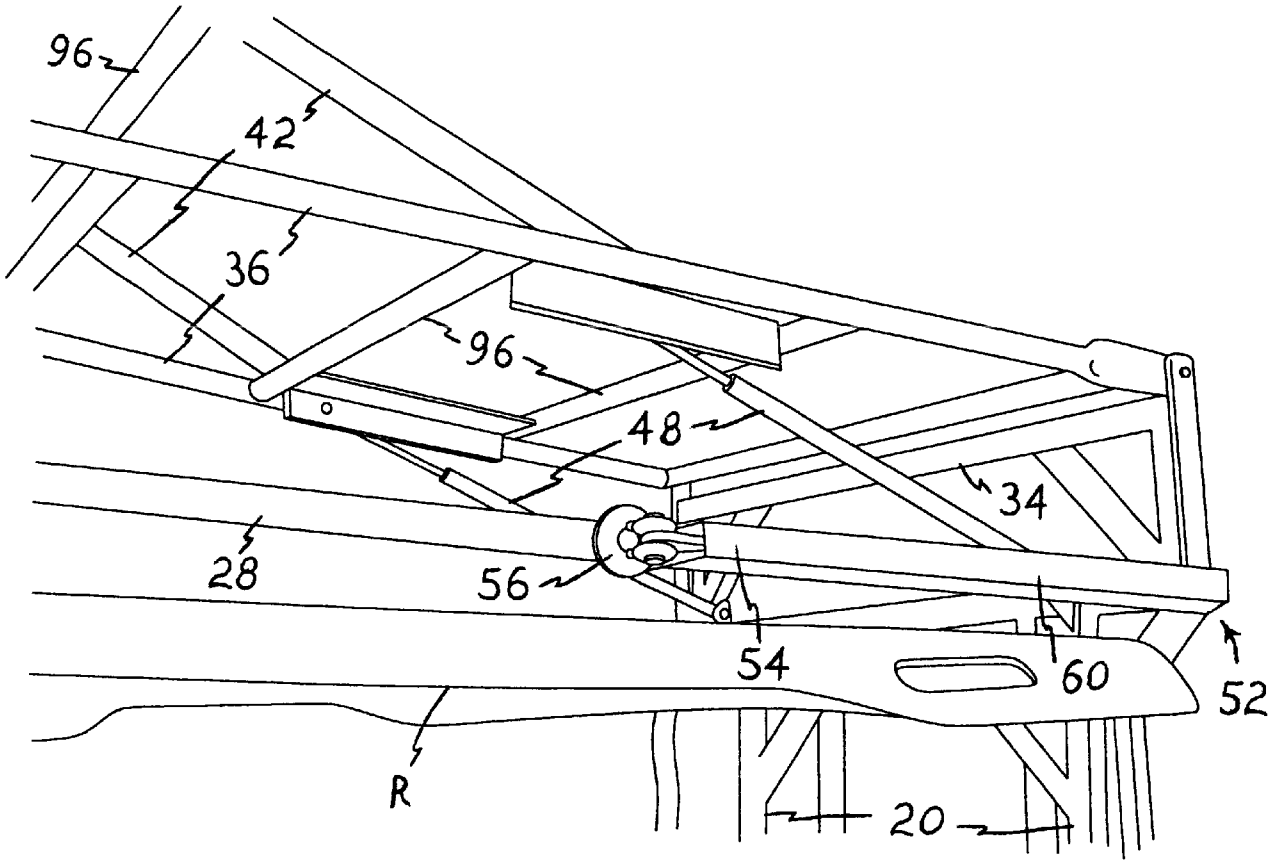
FIG. 4 is a partial left side perspective view, showing details of the upper attachment of the left lateral brace.

(While only the left brace is illustrated in the drawings for clarity therein, it will be understood that the present stand and all of its components are laterally symmetrical.) The braces 52 have attachment ends 54 which are secured to the respective left and right upper frame members 28 and 30 by double acting joints 56, as shown in detail in FIG. 4 of the drawings. These joints 56 permit the braces 52 to swivel from stored positions parallel to the upper frame members 28 and 30, as shown in FIGS. 2 and 4, to outwardly and downwardly extended positions, as shown in FIGS. 1 and 3 of the drawings for the left brace. A lateral pin through the attachment ends 54 of the braces 52, permits them to swing outwardly away from their respective upper frame members 28 and 30 to position their lower ends laterally well away from the vehicle V. Thus, the double acting joints 56 permit their respective braces 52 to move in two independent arcuate degrees of freedom.

The braces 52 are each formed of an inner and an outer member, respectively 58 and 60, with the inner members 58 telescoping within the outer members 60 to adjust the lengths of the braces 52 as required. The length is locked in position as desired by a lateral pin 62 which is installed through mating passages (not shown) conventionally formed through the mating ends of the two brace lengths 58 and 60, as shown in detail in FIG. 3 of the drawings.

FIG. 3 also illustrates the attachment of the left and right lower lateral stabilizer arms provided with the present stand 10. Two lateral tubes 64 are installed beneath the floor or chassis of the vehicle V, with one tube 64 supporting one of the left and right extendible lateral stabilizer arms 66. As in the case of the two stabilizing braces 52, the right side stabilizer arm is not visible in any of the drawing FIGS., but it is obvious that the right side stabilizer arm is provided, due to the lateral symmetry of the stand 10 assembly. The two lateral stabilizer arms 66 are selectively extended from their respective tubes 64 beneath the vehicle V to connect to the respective left and right braces 52.

Each arm 66 has a distal end with a vertically adjustable leveling leg 68 extending therefrom. Each arm 66 distal end includes a collar 70, with the leveling leg 68 passing vertically through the collar 70. A lateral locking pin 72, much like the pin 62 used to secure the telescoping extension of the two components 58 and 60 of each lateral brace 52, is selectively installed through one set of a series of lateral passages in the leg 68 to adjust the leg 68 as desired for uneven terrain, vehicle load, etc. The upper end 74 of each leg 68 includes a fitting which cooperates with the distal end 76 of the lower component 58 of the lateral brace 52, and is secured thereto by a pin 78 to secure the brace 52 to the lateral arm 66 by means of the leg 68 extending therefrom.

Figure 5:
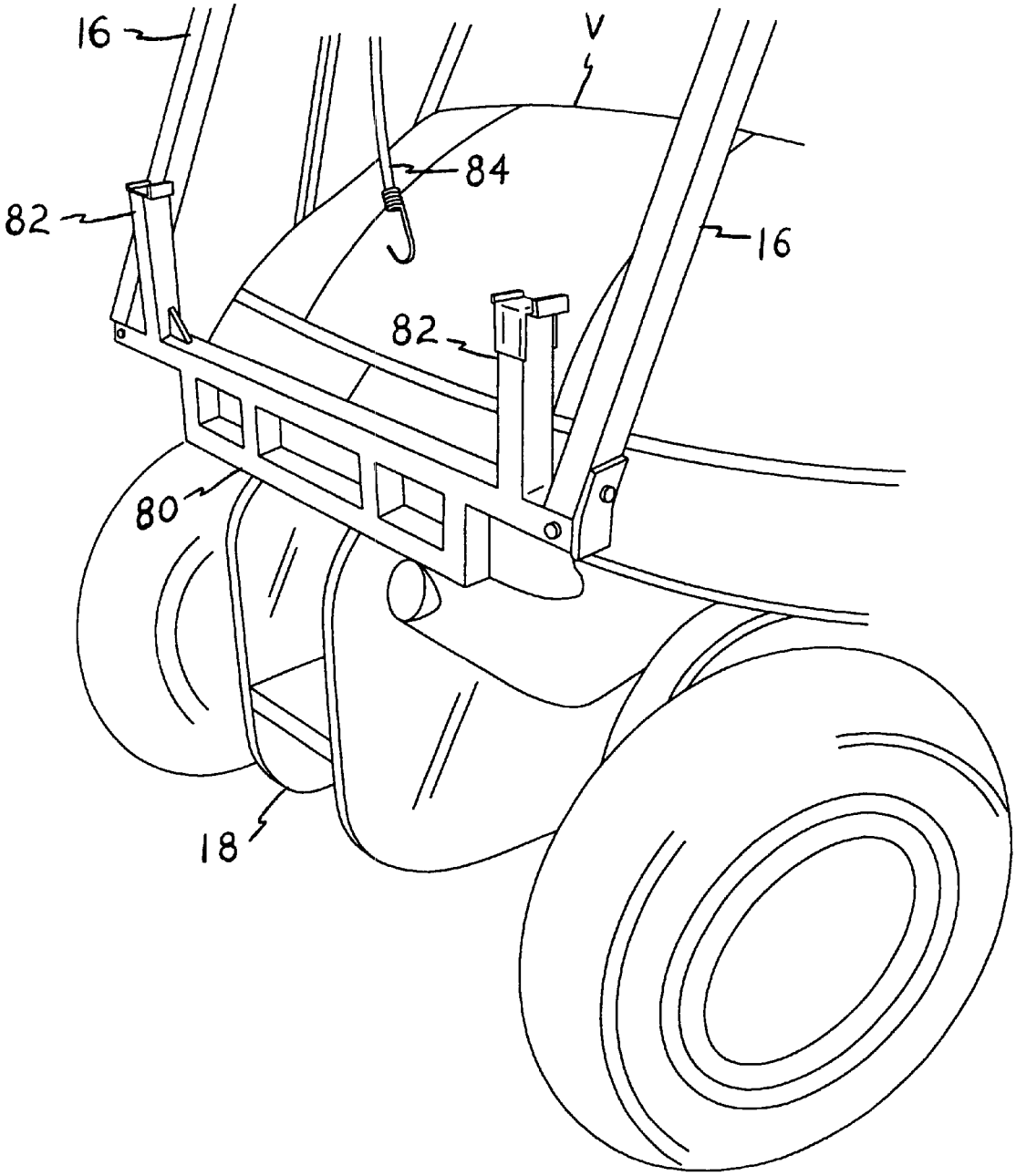
FIG. 5 is a partial front perspective view, showing details of the front attachment and upper portion support structure.

FIG. 5 is a detailed view of the support structure for holding the lower ends of the second upper leg pair 44 for storage and transport of the stand 10. A forward leg support brace 80 extends laterally across the upper end of the forward vehicle attach fitting 18, with its lateral ends connecting to the lower ends of the forward structure 16 of the lower frame 12 to support the forward end of the lower frame 12. A pair of supports 82 extend upwardly from opposite ends of the support brace 80, adjacent the attach points for the lower frame forward structure 16 members. These supports 82 serve as rests for the lower ends 46 of the second or forward legs 44 of the stand upper portion 14, when the upper portion 14 is lowered for storage and transport as shown in FIG. 2. A bungee cord 84 or the like may be used to secure the lower frame forward structure 16 members to the forward support 80.

Figure 6:
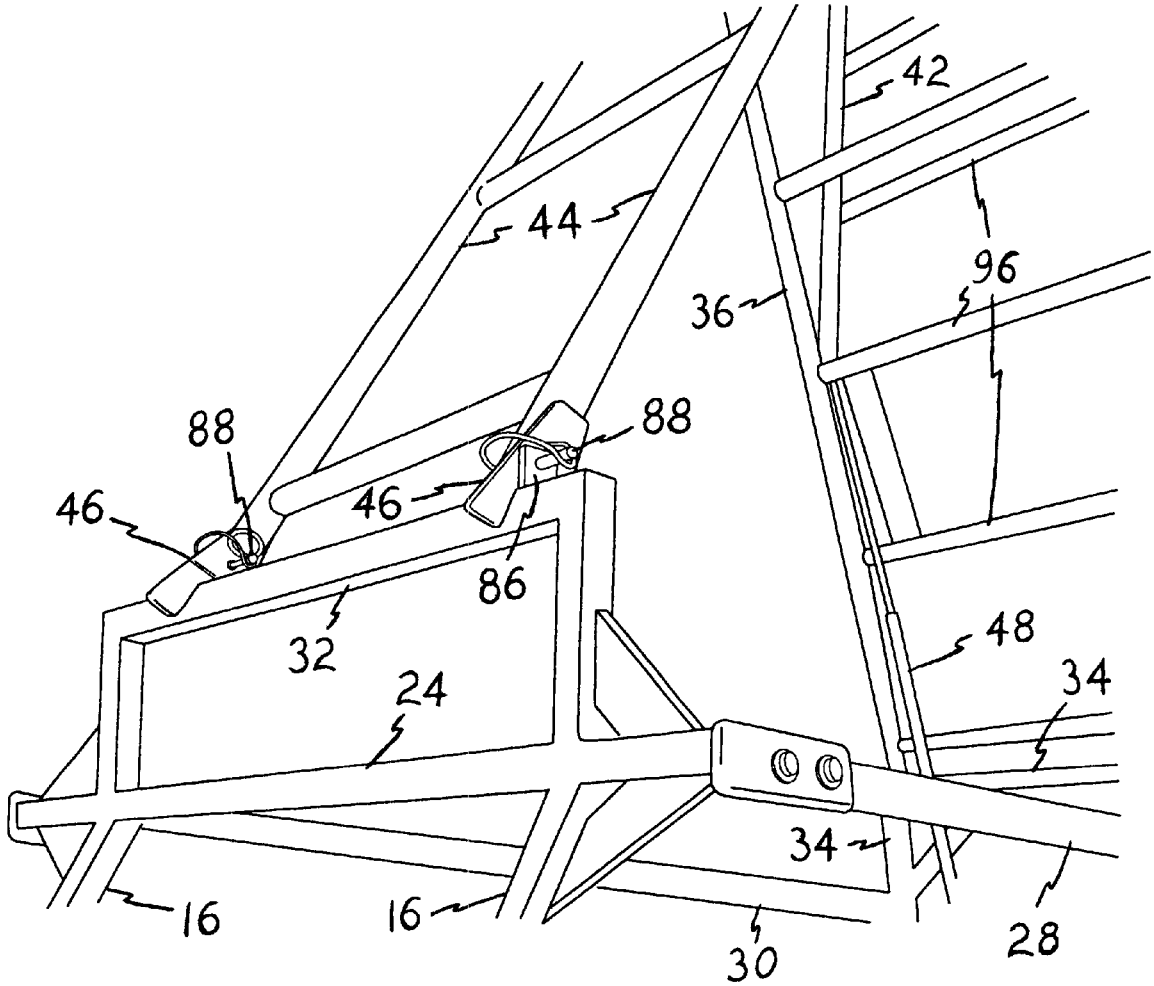
FIG. 6 is a partial front perspective view, showing details of the front brace attachment for the erected upper portion.

FIG. 6 shows the means for securing the second upper legs 44 in place when the stand upper portion 14 is erected as shown in FIG. 1. A pair of ears or lugs 86 (one of which is shown in FIG. 6) extends upwardly from the forward upper structure support 32 Each lower end 46 of the second legs 44 of the upper stand portion 12 comprises a fork which fits over the upper bar of the support 32, adjacent a respective lug 86. The lugs 86 and lower end forks 46 are provided with conventional pin passages (not shown) formed laterally therethrough, for accepting respective locking pins 88 (similar to the pins 62 and 78 shown in FIG. 3) which may be selectively installed through each lower end fork 46 and lug 86 assembly to secure the second or forward legs 46 in place when the, upper portion 14 of the stand 10 is erected. The lower end forks 46 straddle the two upper ends of the forward leg support struts 82 (shown in FIG. 5), when the stand upper portion 14 is folded.

Figure 8:
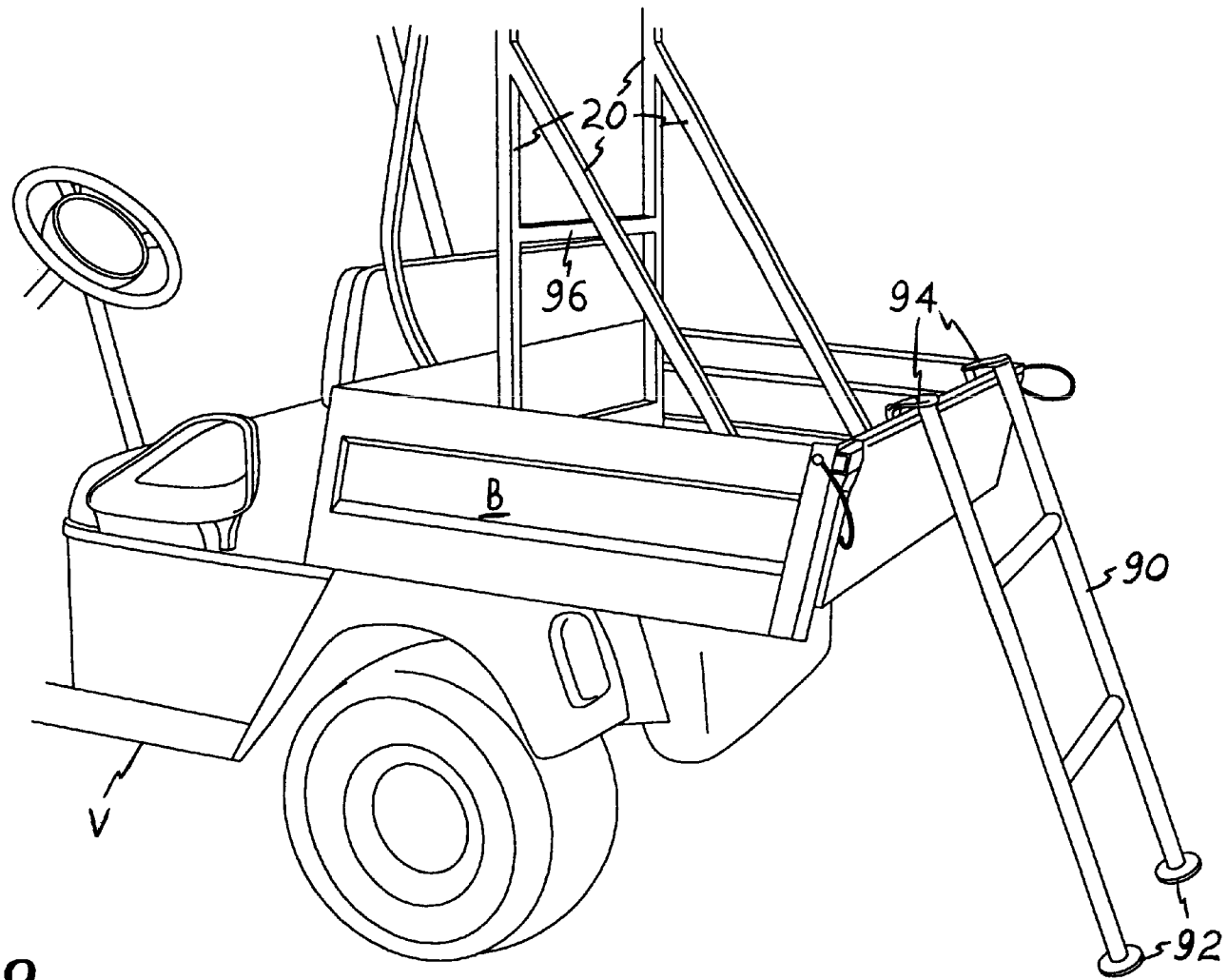
FIG. 8 is a partial left side and rear perspective view, showing the deployment of the ladder for climbing aboard the back of the vehicle when the stand is erected.

FIGS. 7 and 8 respectively illustrate the stowed and deployed positions for a ladder 90 which is used for climbing aboard the, vehicle V to ascend the stand 10 when it is erected. The ladder 90 has a pair of support pads 92 at the lower ends of the two lateral members, similar to the support pads provided for the leveling legs 68 and shown in FIG. 3. The upper ends of the lateral members include hooks 94 for securing the ladder 90 to the rear crossmember 96 of the upper structure 22 of the lower frame portion 12, just below the horizontal member of the rear upper structure support, assembly 34. A bungee cord (not shown) may be used to secure the ladder 90 to the rear support structure 20 for storage.

FIG. 8 of the drawings shows the ladder 90 removed from its stored position shown in FIG. 7, and deployed against the cargo box B of the vehicle V to facilitate access to the lower rear support structure 20 for climbing the erected stand 10. The upper hooks 94 are hooked over the upper edge of the back or tailgate of the box B, to secure the ladder 90 as it extends from the vehicle V. The footpads 92 are resting upon the underlying surface. A person using the present stand 10 may climb aboard the vehicle V by means of the ladder 90, thence ascending the lower rear support structure 20, the upper rear legs 36, and the upper rear auxiliary braces 42 to gain access to the seating platform 40 and seat 50. A series of horizontal cross braces 96 serve as rungs between the generally upright members of each of the above structures 20, 36, and 42 to facilitate climbing the stand 10.

Figure 9:
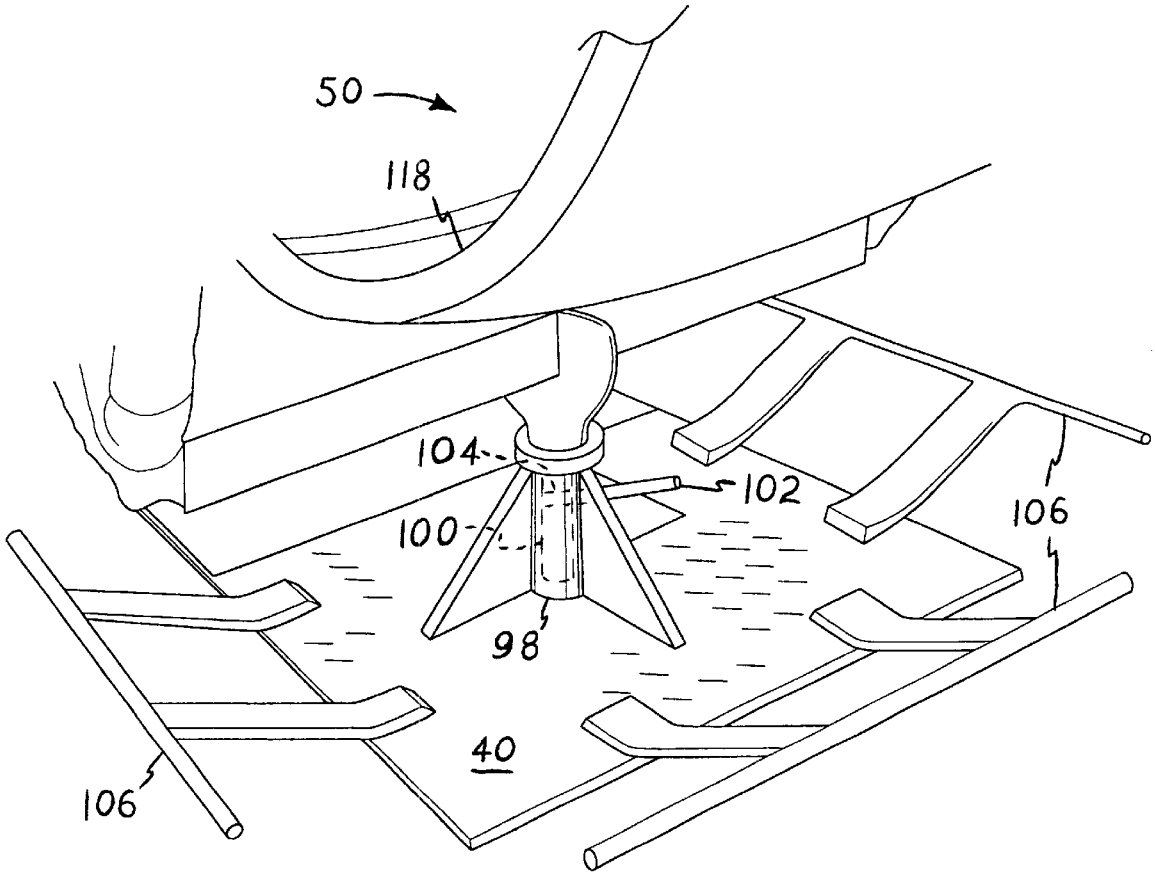
FIG. 9 is a partial perspective view showing the pivotal attachment of the seat to the upper platform of the stand.
Figure 10:
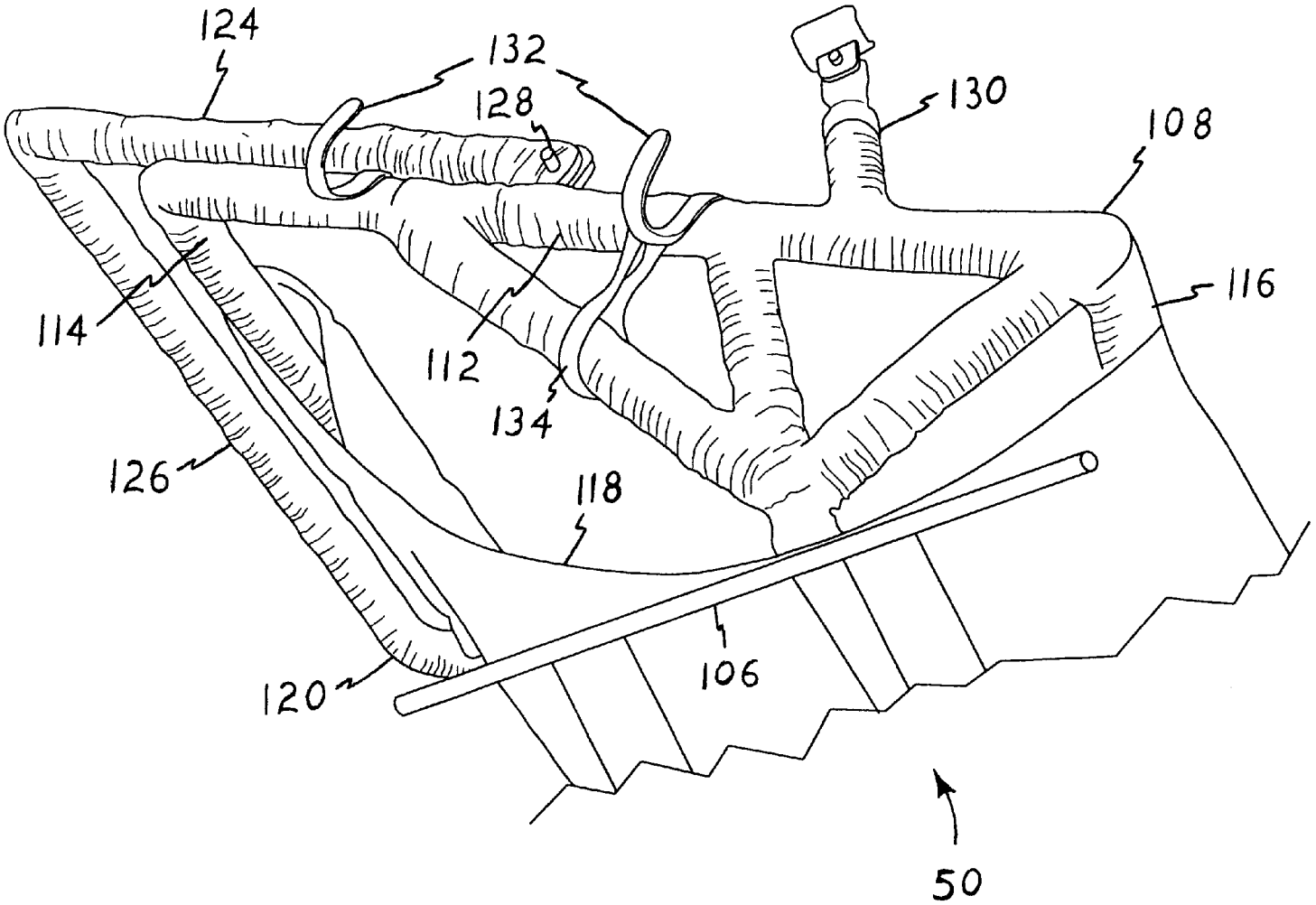
FIG. 10 is a partial perspective view showing the right side of the seat frame and pivotally attached safety guard and rest.

FIGS. 9 and 10 illustrate details of the seat 50 and seating platform 40 assemblies of the present stand 10. In FIG. 9, the means for removably and rotatably securing the seat 50 to the seating platform 40 is shown. The seating platform 40 includes a generally cylindrical socket 98 extending upwardly therefrom, i.e., when the upper portion 14 of the stand 10 is in its erected state. The seat assembly 50 includes a cylindrical seat mounting plug 100 (shown in broken lines in FIG. 9) which fits closely within the socket 98. The seat 50 may be immovably secured to the platform 40 by means of a locking pin 102, which is inserted through a lateral passage 104 formed through the seat support socket 98 of the seating platform 40 and the seat mounting plug 100 of the seat 50.

The seat assembly 50 is normally secured and immovably affixed to the seating platform 40, and thus to the stand 10 structure, by installing the removable seat retaining pin 102 through the seat support socket 98 and seat mounting plug 100, as shown in FIG. 9 and described above. This is the normal condition for storage and transport of the stand 10 assembly, as shown in FIG. 2. The seat assembly 50 is oriented so that a seated person would face rearwardly atop the stand 10, when the seat 50 is immovably secured to the platform 40. This allows the person using the stand 10, to climb aboard the platform 40 from the back and face the seat 50 before turning around, as is normally done when taking a seat.

The seating platform 40 includes a series of footrests 106 extending from the front, left, and right sides thereof. However, no footrest is provided at the open rear side of the seating platform 40, in order to provide clearance for the person using the stand as he or she climbs aboard the seating platform 40. Once the person is seated, the seat retaining pin 102 is removed and stored, thus freeing the seat assembly 50 to rotate atop the platform 40 as desired to provide a 360 degree field of view for the observer seated therein. This is preferable to the alternative of removing the locking pin 102 from the seat retaining socket 98 before erecting the upper portion 14 of the stand 10. While the socket 98 is oriented forwardly and upwardly when the upper portion 14 of the stand 10 is folded, the seat 50 would be free to rotate and thus may not be properly oriented to facilitate seating, if the pin 102 is removed before erecting the upper portion 14 of the stand 10.

FIG. 10 provides a perspective view of the right side of the seat assembly 50, i.e., the side which would be to the right of a person seated therein. The seat assembly 50 comprises a generally rectangular frame 108 having a left arm 110 (shown generally in FIG. 2) and a right arm 112, each sloping forwardly and downwardly relative to the position of a person seated therein. The frame 108 slopes from a relatively high back member 114, to a lower forward member 116 which passes beneath the knees or thighs of a person seated therein, generally as shown in FIG. 1 of the drawings. The entire frame assembly 108 is preferably covered with a non-reflective camouflage material, with a sling type seat 118 extending from the lateral back member 114 to the lateral forward member 116. Other seating types and configurations may be provided as desired, but the seat assembly 50 described herein is relatively light weight and provides good comfort for the seated person.

The present seat assembly 50 also includes a safety guard rail and equipment rest 120, which may be pivotally placed around the seated person as desired. The safety guard and equipment rest 120 comprises a squared, but generally U-shaped bar or tube having a left member 122 (shown generally in FIG. 1), an opposite right member 124, and a lateral member 126. The attachment ends of the left and right side members 122 and 124, e.g., the attachment end 126 of the right side member 124 shown in FIG. 10, are secured to the respective arms 110 and 112 of the seat 50 structure by lateral pivot pins 128. A vertically adjustable (e.g., threaded adjuster, etc.) safety guard support 130 extends upwardly from each arm.

Once the user of the present stand 10 is seated within the seat assembly 50, the safety guard and equipment rest 120 is pivoted arcuately from its position as shown in FIG. 9, with the crossmember 126 moving upwardly, forwardly over the head of the seated person, and downwardly to a rest position across the front of the seated person, generally as shown in FIG. 1. The two lateral bars 124 and 126 rest in the shoes or retainers atop the vertically adjustable safety guard supports 130 (not shown in FIG. 1, for clarity in the drawing) , with the seated person being safely surrounded by the seat back member 114, the two safety guard side members 122 and 124, and the safety guard lateral member 126 extending across the front of the seated person. The person may adjust the height of the safety guard 120 as desired, by adjusting the heights of the two safety guard height adjusters 130 as desired in order to position the safety guard crossmember 126 at the desired height for use as an equipment or weapons rest, etc.

The weapon or other equipment to be used by the person seated in the present stand 10, may be temporarily stowed or secured by means of equipment holders 132 disposed along one or both arms 110 and/or 112 of the seat assembly 50. As most persons are right handed, a pair of such equipment holder hooks 132 are provided to extend from the right side arm 112 of the seat assembly 50, as shown in FIG. 10. These hooks 132 may be used to support a rifle or other firearm, archery bow, and/or other equipment as desired. A bungee strap 134 or other retaining means may be provided to assure that the equipment does not fall from the holders 132.

In conclusion, the present utility stand provides the hunter, wildlife observer, photographer, and/or others, with an extremely versatile and efficient means of achieving an elevated viewpoint. The mobility provided by the relatively small and light weight off road vehicle upon which the present stand is installed, enable a user of the stand to transport it to virtually any practicable location desired, with the stand and vehicle combination having essentially the same mobility as such an off road vehicle alone. The stability provided by the longitudinally disposed bracing which attaches to the extreme ends of the vehicle, rather than extending only from one end or the center of the vehicle as in many prior art stands, provides a considerable improvement in stability and safety over other stands of the prior art. Moreover, the lateral bracing provided by the present stand provides even further improvements in stability and safety for the user.

The present stand is easily erected or stowed in a matter or a couple of minutes. The ease of use of the present stand enables persons with limited mobility to enjoy the benefits of an elevated site for hunting, game observation, or other purposes as desired, so long as they are capable of climbing to the seat of the erected stand. The present stand will prove most valuable to security personnel, lifeguards, and virtually anyone who can profit from the mobility, versatility, ease of use, and high viewpoint provided.

It is to be understood that the present invention is not limited to the embodiment described above, but encompasses any and all embodiments within the scope of the following claims.

We claim:

1. A portable utility stand for an off road vehicle, comprising:

a lower frame portion;

at least a forward and a rearward vehicle attachment fitting extending from said lower frame portion, for immovably affixing said lower frame portion to the off road vehicle;

said lower frame portion further including an upper structures having a forward portion, a rear portion, and a left and a right side member;

an upper frame portion pivotally attached to said rear portion of said upper structure of said lower portion, and foldably extending upwardly from said upper structure of said lower frame portion for selectively erecting said upper frame portion;

said upper frame portion further including an upper end with a seating platform immovably affixed thereto;

a seat extending from said seating platform;

a left and a right lateral stabilizer brace foldably extending respectively from said left side member and said right side member of said upper structure of said lower frame portion; and a left and a right lower lateral stabilizer arm for selectively extending from the off road vehicle, and removably connecting respectively to said left and said right lateral brace, each said left and said right lower lateral stabilizer arm each further includes a vertically adjustable leveling leg.

2. The portable utility stand according to claim 1, further including at least one lift assist strut disposed between said upper structure of said lower frame portion and said upper frame portion, for reducing lifting forces required when erecting said upper frame portion.

3. The portable utility stand according to claim 1, wherein:

said seating platform further includes a cylindrical seat support socket extending upwardly therefrom when said upper frame portion is erected; and said seat further includes a cylindrical seat mounting plug extending therefrom and rotatably fitting within said seat support socket so that said seat is revolvingly fitted to said seating platform.

4. The portable utility stand according to claim 1, further including means for removably securing said seat to said seating platform.

5. The portable utility stand according to claim 1, wherein:

said seat further includes a left arm and a right arm; and at least one said arm further includes equipment holder means extending therefrom.

6. The portable utility stand according to claim 1, wherein:

said seat further includes a left arm and a right arm;

each said arm further includes a generally U-shaped safety guard and equipment rest pivotally secured thereto; and said safety guard and equipment rest selectively surrounding said seat and any person seated therein when pivotally displaced forwardly and downwardly generally in front of said seat.

7. The portable utility stand according to claim 1, further including at least one footrest extending from said seating platform.

8. The portable utility stand according to claim 1, further including a removable ladder for selectively placing against the off road vehicle, for accessing said lower frame portion extending from the off road vehicle and thence said upper frame portion and said seat extending from said lower frame portion when said upper frame portion is erected.

9. An off road vehicle and portable utility stand, comprising in combination:

an off road vehicle;

a utility stand including a lower frame portion;

at least a forward and a rearward vehicle attachment fitting extending from said lower frame portion of said utility stand, for immovably affixing said lower frame portion of said utility stand to said off road vehicle;

said lower frame portion of said utility stand further including an upper structure having a forward portion, a rear portion, and a left and a right side member;

said utility stand further including an upper frame portion pivotally attached to said rear portion of said upper structure of said lower portion thereof, and foldably extending upwardly from said upper structure of said lower frame portion thereof for selectively erecting said upper frame portion thereof;

said upper frame portion of said utility stand further having an upper end with a seating platform immovably affixed thereto;

a seat extending from said seating platform, said seat further includes a left arm and a right arm, each said arm further includes a generally U-shaped safety guard and equipment rest pivotally secured thereto, said safety guard and equipment rest selectively surrounding said seat of said utility stand and any person seated therein when pivotally displaced forwardly and downwardly generally in front of said seat;

a left and a right lateral stabilizer brace foldably extending respectively from said left side member and said right side member of said upper structure of said lower frame portion of said utility stand; and a left and a right lower lateral stabilizer arm selectively extending from said off road vehicle, and removably connecting respectively to said left and said right lateral stabilizer brace.

10. The off road vehicle and portable utility stand combination according to claim 9, wherein said left and said right lower lateral stabilizer arm of said utility stand each further includes a vertically adjustable leveling leg.

11. The off road vehicle and portable utility stand combination according to claim 9, further including at least one lift assist strut disposed between said upper structure of said lower frame portion and said upper frame portion of said utility stand, for reducing lifting forces required when erecting said upper frame portion of said utility stand.

12. The off road vehicle and portable utility stand combination according to claim 9, wherein:

said seating platform of said utility stand further includes a cylindrical seat support socket extending upwardly therefrom when said upper frame portion of said utility stand is erected; and said seat of said utility stand further includes a cylindrical seat mounting plug extending therefrom and rotatably fitting within said seat support socket so that said seat is revolvingly fitted to said seating platform of said utility stand.

13. The off road vehicle and portable utility stand combination according to claim 9, further including means for removably securing said seat of said utility stand to said seating platform thereof.

14. The off road vehicle and portable utility stand combination according to claim 9, wherein:

said seat of said utility stand further includes a left arm and a right arm; and at least one said arm further includes equipment holder means extending therefrom.

15. The off road vehicle and portable utility stand combination according to claim 9, further including at least one footrest extending from said seating platform of said utility stand.

16. The off road vehicle and portable utility stand combination according to claim 9, further including a removable ladder fork selectively placing against said off road vehicle, for accessing said lower frame portion of said utility stand extending from said off road vehicle and thence said upper frame portion of said utility stand and said seat extending from said lower frame portion of said utility stand when said upper frame portion of said utility stand is erected.

17. The off road vehicle and portable utility stand combination according to claim 9, wherein said off road vehicle is a golf cart.

* * * * *